United States Patent [19]

Landaeus et al.

[11] Patent Number: 4,569,402

[45] Date of Patent: Feb. 11, 1986

[54] METHOD OF CONTROLLING IMPACT FORCE AND SHOCK INTERVAL IN DROP HAMMERS

[76] Inventors: Kjell Landaeus, Domaine de St. Andrieu 3, 02670 Villeneuve-Loubet, France; Bertil Borg, Kastberga 2, S-241 00 Eslov, Sweden

[21] Appl. No.: 471,172

[22] Filed: Mar. 1, 1983

[51] Int. Cl.[4] ..... B23B 45/16

[52] U.S. Cl. ..... 173/126; 173/139

[58] Field of Search ..... 173/1, 101, 103, 139, 173/126, 127; 72/435, 436, 437, 438, 439, 440; 267/137, 136, 138, 151

[56] References Cited

U.S. PATENT DOCUMENTS

| | | | |
|---|---|---|---|
| 2,101,869 | 12/1937 | Noble | 267/137 |
| 2,800,884 | 7/1957 | Mori | 173/103 X |
| 3,709,478 | 1/1973 | Kisling, III | 267/137 |
| 3,796,271 | 3/1974 | Amtsberg | 173/103 X |
| 3,823,786 | 7/1974 | Voitsekhousky et al. | 173/126 |
| 3,947,008 | 3/1976 | Mullins | 267/137 X |
| 4,204,421 | 5/1980 | Rogers et al. | 72/439 |
| 4,350,214 | 9/1982 | Landaeus | 173/126 |

FOREIGN PATENT DOCUMENTS

| | | | |
|---|---|---|---|
| 94329 | 9/1897 | Fed. Rep. of Germany | 267/1 E |
| 479557 | 11/1975 | U.S.S.R. | 72/435 |

*Primary Examiner*—James M. Meister
*Assistant Examiner*—Willmon Fridie, Jr.
*Attorney, Agent, or Firm*—Cushman, Darby & Cushman

[57] ABSTRACT

Method of controlling impact force and shock interval at a drop hammer of the type which has a core (10) and a number of casings (12, 14, 16, 19) arranged concentrically around the core. Between the core and the casings, spacings are arranged, and the core and the casings are interconnected alternatingly at one end and the other beginning at the upper end of the core. Between the lower end of the core and those ends of one or more casings, which are not permanently connected, a shock wave transferring connection is provided to short-circuit the path of the shock wave through the core and the casings.

1 Claim, 2 Drawing Figures

METHOD OF CONTROLLING IMPACT FORCE AND SHOCK INTERVAL IN DROP HAMMERS

The invention relates to drop hammers for driving piles or the like into the ground, comprising a core which forms an impact surface at one end thereof, and casings which are mutually spaced substantially concentrically around the core, the casing closest to the core being connected at one end thereof with the core at the other end thereof while other casings are interconnected alternatingly at one end and the other beginning at the other end of said casing closest to the core.

In the ideal case a drop hammer should be substantially of the same length as the pile to be driven down into the ground by means of the drop hammer. However, this is impractical and therefore the drop hammer is arranged as described above in order to obtain a long path of propagation for the shock wave while the drop hammer as such has a short length.

More particularly, the invention relates to a method of controlling impact force and shock interval in a drop hammer of the type referred to above. It is desired to control impact force and shock interval for the reason that for driving a pile into the ground it may be necessary to have less force and longer shock instead of greater force and shorter shock in order that the pile will not wreck during driving.

The primary object of the invention is to make possible that impact force and shock interval are adapted to the ground conditions and the pile material in the most favourable manner.

Additional objects of the invention in part will be set forth in the description which follows and in part will be obvious from the description.

To achieve the foregoing objects and in accordance with the purpose of the invention as embodied and broadly described herein the invention provides a method of controlling impact force and shock interval in a drop hammer for driving piles or the like into the ground, comprising a core which forms an impact surface at one end thereof, and casings which are mutually spaced substantially concentrically around the core, the casing closest to the core being connected at one end thereof with the core at the other end thereof while other casings are interconnected alternatingly at one end and the other beginning at the other end of said casing closest to the core, wherein at the ends of the core and the casings, respectively, which are not permanently connected, a shock wave transferring connection is provided between the core and a voluntary number of casings.

Figure 1:
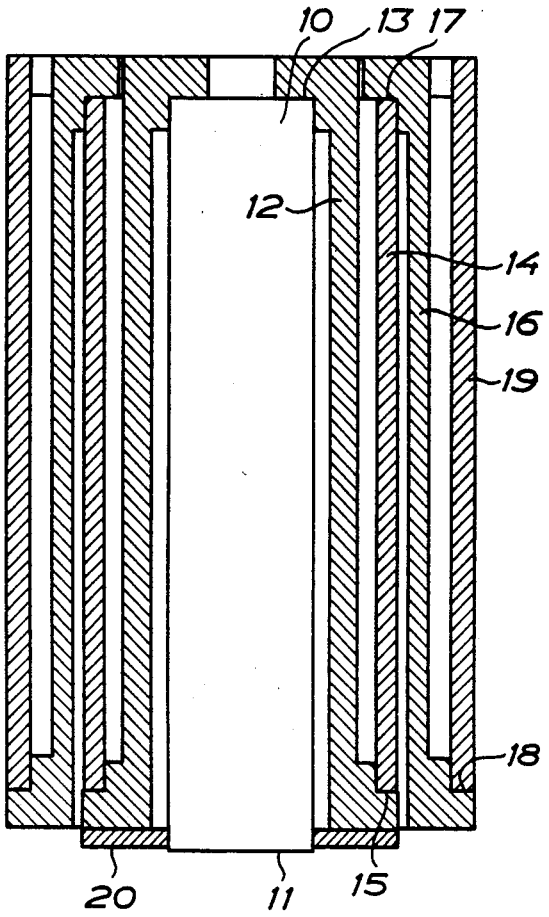
Figure 2:
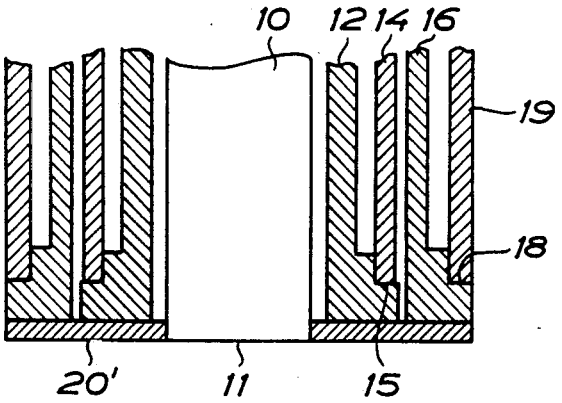

The invention will be explained in more detail below with reference to the accompanying drawing, in which FIG. 1 is a longitudinal cross-sectional view of a drop hammer of the type used in practising the method of the invention, and FIG. 2 is a fragmentary longitudinal cross-sectional view similar to that in FIG. 1 of the lower end of the drop hammer.

The drop hammer in FIG. 1 comprises a cylindrical core 10 which forms an impact surface 11 at one end thereof. At the other end a first casing 12 is permanently connected to the core 10 at 13, and this casing surrounds the core concentrically spaced therefrom. Outside the casing 12 a second casing 14 is arranged concentrically with the core, and also the casings 12 and 14 are mutually spaced. The casing 14 is permanently connected to the casing 12 at the lower end of the drop hammer at 15, and it is surrounded by a third casing 16 which is concentric with the core and is spaced from the casing 14. At 17 at the upper end of the drop hammer a permanent connection is provided between the casings 14 and 16 while said latter casing 16 at the lower end of the drop hammer is permanently connected at 18 to a fourth casing 19 spaced from the casing 16 and arranged concentrically with the core.

A shock wave generated in the core 10 when hitting a pile at the impact surface 11, will propagate through the core to the upper end thereof and via the connection at 13 to the casing 12, then downwards through said latter casing and via the connection at 15 upwards through the casing 14 from which the shock wave will pass to the casing 16 via the connection at 17 to propagate down the casing 16 and then via the connection 18 upwards through the casing 19. The shock wave then will be reflected back along the path described to the impact surface 11.

In order to shorten the propagation path of the shock wave there is provided by the method according to the invention a shock wave transferring connection, "short circuiting", between the core and a voluntary number of casings. Thus, a short circuiting is shown in FIG. 1 between the core 10 and the second casing 14 and it is provided by means of a ring 20 at the lower end of the drop hammer such that the shock wave will propagate from the impact surface 11 via the ring 20 and the connection 15 directly to the casing 14 so as to follow thereafter the same path as before to the upper end of the casing 19. This shortening of the path of the shock wave provides a greater impact force; however, the shock interval will be shorter.

The impact force can be further increased by short circuiting several casings as is shown in FIG. 2 wherein a ring 20' forms a shock wave transferring connection from the core 10 directly to the outermost casing 19, which means that the shock interval will be still shorter than in the arrangement shown in FIG. 1. By using rings of different sizes in order to provide a shock wave transferring connection between the core and the casings at the ends where permanent connection is not arranged, it is possible to adapt impact force and shock interval to the prevailing conditions, i.e. to the ground nature and the material of the pile to be driven down into the ground.

The rings 20 and 20', respectively, can be attached in different manners by means of screw connections, clamp connections or the like. It is important, however, that the ring is securely attached while it is at the same time possible to replace easily the ring.

E.g. the core 10 can form a shoulder facing downwards at the lower end of the core, said shoulder surrounding the impact surface 11 axially spaced therefrom. The ring 20 or 20' can be attached to the shoulder by means of screws which are passed through the ring to engage threaded bores in the shoulder. The ring can also be attached to the casing 15 or the casing 19 as the case may be, by similar screw connections.

We claim:

1. A drop hammer for driving piles or the like into the ground, said hammer comprising an elongated cylindrical core having at one end an impact surface, a plurality of concentrically disposed casings each having a progressively larger diameter relative to an adjacent inner casing, each casing having a first end and a second end opposite said first end with each first end being adjacent said impact surface of said core, the innermost casing being connected adjacent its second end to the end of said core opposite said impact surface, the innermost and next adjacent casings being connected together at their respective first ends with the subsequent casings being connected together alternately at said second and first ends thereof, whereby each casing is attached to an adjacent casing, said drop hammer including a shock wave transferring connection plate element rigidly and permanently connected between said core, adjacent said impact surface thereof, and the adjacent end of at least the innermost one of said casings thereby to shorten the path of the shock wave to provide a greater impact force.

* * * * *